United States Patent [19]

Chiu

[11] Patent Number: 4,794,869

[45] Date of Patent: Jan. 3, 1989

[54] STRUCTURE OF EXTENDABLE TABLES

[76] Inventor: Jack Chiu, No. 426, Wan Tan Road, Wan Tan Hsiang, Ping-Tung Hsien, Taiwan

[21] Appl. No.: 150,854

[22] Filed: Feb. 1, 1988

[51] Int. Cl.[4] ..... A47B 1/08

[52] U.S. Cl. ..... 108/86; 108/87

[58] Field of Search ..... 108/86, 83, 87, 86, 108/89, 67

[56] References Cited

U.S. PATENT DOCUMENTS

| | | | |
|---|---|---|---|
| 656,293 | 8/1900 | Horn | 108/67 |
| 1,358,353 | 11/1920 | Zimmer | 108/84 X |
| 1,853,527 | 4/1932 | Wurm | 108/67 |
| 1,862,113 | 6/1932 | Dreckschmidt | 108/86 X |
| 1,907,111 | 5/1933 | Holland et al. | 108/86 X |
| 2,205,274 | 6/1940 | Rastetter | 108/67 |
| 2,631,910 | 3/1953 | Mareček | 108/67 |
| 3,336,883 | 8/1967 | Wengi | 108/86 |
| 4,553,485 | 11/1985 | Lee | 108/86 |

*Primary Examiner*—Peter A. Aschenbrenner
*Attorney, Agent, or Firm*—David H. Semmes

[57] ABSTRACT

A table comprising two semi-elliptical plates, table legs, two posts, and an engaging plate formed of a first plate and a second plate hinged together. Several protrusions are disposed at either side of the engaging plate and a side plate is arranged on each of the two posts. At both ends of the side plates are connected with two rails. Thus, a rotating space is formed between the side plates and rails such that the engaging plate can either be positioned between two semi-elliptical plates to form a larger table or it can be concealed within the rotating space to form a smaller table.

1 Claim, 4 Drawing Sheets

STRUCTURE OF EXTENDABLE TABLES

BACKGROUND OF THE INVENTION

The present invention relates to an improved structure of extendable tables.

At present, there are extendable table designs to facilitate the use of limited space available in the ordinary dining room. Often the extendable table is folded to have a smaller table surface, thus occupying less space. When more people need to share the table, then the extendable table can be extended to have a lare table surface.

Referring to FIG. 5, it can be seen that the prior art extendable table comprises two symmetrically semicircular plates (a). These two semi-circular plates, or table top pieces, are engaged with a rail (a1) and a base plate (b). A bar (a2) extending from the semi-circular plates is slidable at the rail (a1). At the upper part of the inner sides of these two semi-circular plates (a), there are disposed a plurality of cavities (a4) and a hole (a3) is disposed at the lower part thereof, respectively. The holes (a3) can receive two pivot ends (c1) of a pivot (c). There are two T-shaped projections (c2) formed at the pivot (c). A rotating plate (d) is formed of two plates hinged together. At both sides of the rotating plate (d) there are disposed a plurality of small protrusions (d2), respectively. Two T-shaped grooves (d1) are arranged at one plate of the rotating plate (d), whereby the T-shaped bars (c2) can be mounted within the T-shaped grooves (d1) and the rotating plate (d) can be opened up with its two plates forming a plane to be put between the two semi-circular plates (a). The small protrusions (d2) will be mounted within the cavities (a4) thus forming an extended table. When intended to decrease the size of the table, a plate of the rotating plate (d) is superimposed on the other plate and then it is turned 180 derees by virtue of the pivot (c), thereby accomodating the rotating plate (d) within the space between the rail (a1), the semi-circular plates (a) and the base plates (b). Then the two semi-circular plates can be pushed together and the surface area of the table is reduced.

However, the aforesaid extendable table suffers from the following drawbacks:

(1) The pivot piece ends (c1) are to be inserted into the holes (a3). Since the distance between these two holes (a3) is fixed, it is necessary to exert a big force on the pivot piece (c) to mount the pivot piece between the two holes (a3), thus causing a lot of trouble in assembling work.

(2) The base plate (b) is arranged to receive rotating plate (d) thereon and prevents the rotating plate (d) from dropping off. However, the base plate (b) is planar in shape, and when the user rotates the rotating plate (d), the rotating plate (d) is likely to hit the base plate (b), thus obscuring the rotating operation.

(3) Since there is only sliding movement between the T-shaped bar (c2) and the T-shaped groove (d1) and no fixing means disposed therebetween, it is very possible that the rotating plate (d) might escape from the pivot piece (c), and a that a troublesome reinstallation would be necessary.

SUMMARY OF THE INVENTION

Accordingly, the object of the present invention is to overcome the aforesaid problems encountered in the prior art extendable table.

One of the features of the present invention is to use a pin to fix an engaging plate at a fixing place of the extendable table, thereby stabilizing the operation of the engaging plate.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
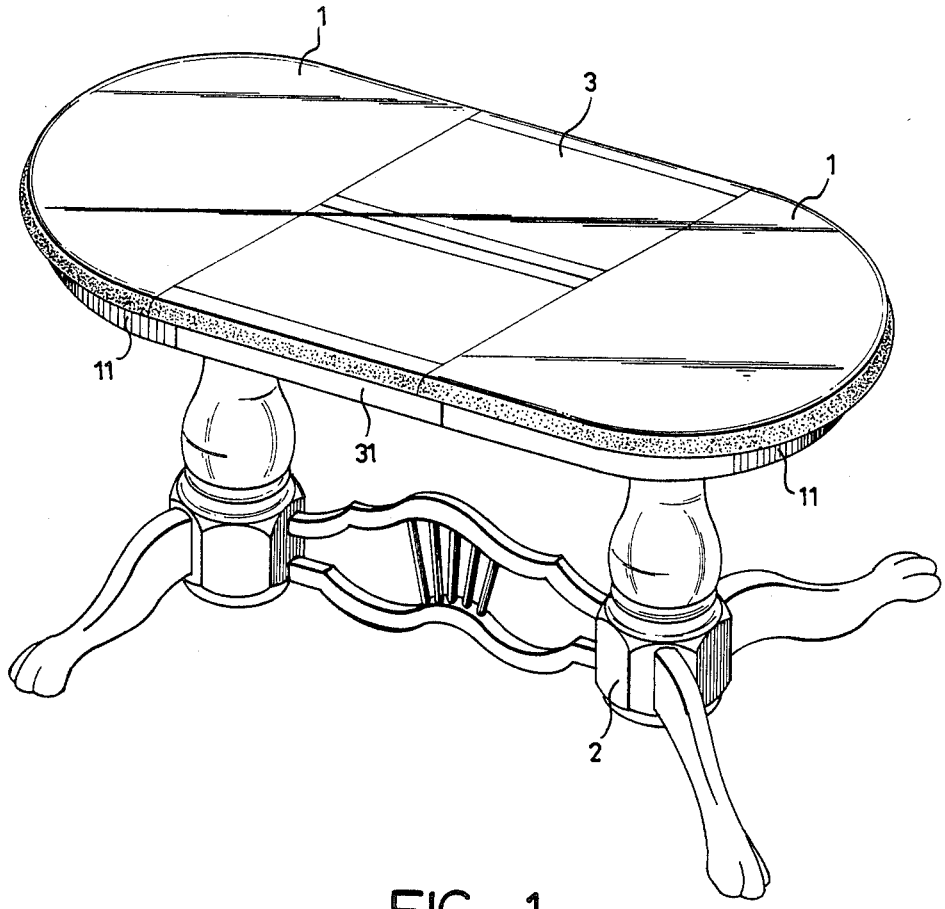
FIG. 1 is a perspective view of an extendable table in accordance with the invention.
Figure 2:
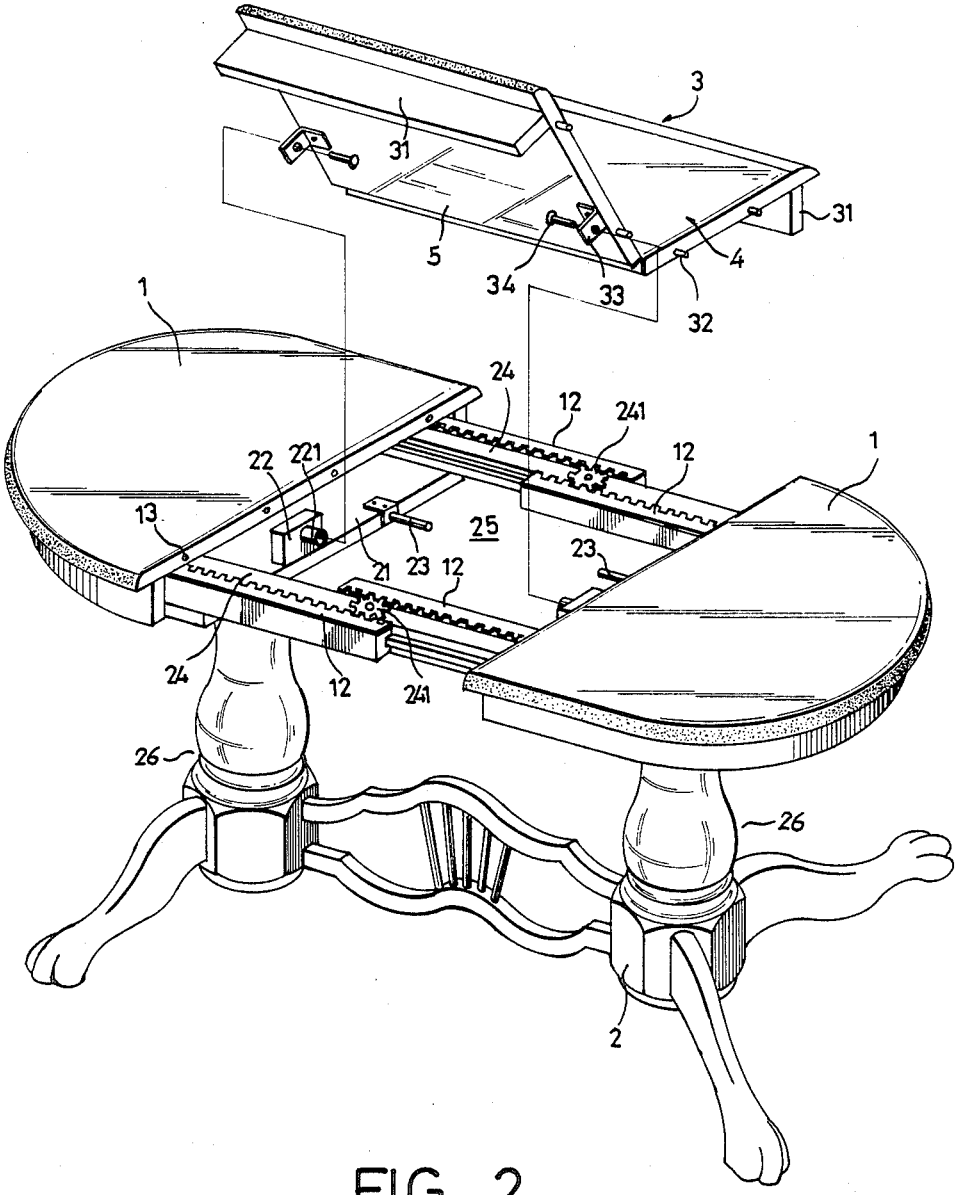
FIG. 2 is an exploded view of the extendable table in accordance with the present invention.

Referring to FIGS. 1 and 2, it can be seen that the present invention is composed of two plates 1 (in this exemplary case semi-elliptical plates), table legs 2 and an engaging plate 3. Two posts 26 are supported by the table legs 2. A respective side plate 21 is disposed on each of the posts 26. At the rear and front ends of both side plates 21 two rails 24 are connected, whereby a rotation space 25 is formed between there two side plates 21 and two rails 24. A fixing seat 22 and a supporting pin 23 are fixed at central locations on each of the two side plates 21. On the fixing seat 22 there is also arranged a hollow protrusion 221. An engaging plate 3 is formed from a first plate 4 and a second plate 5, which are hinged together. At the front and rear ends of the engaging plate 3, there are arranged respective edge plates 31, and at the left and right ends of the same there are disposed several protrusions 32. At the bottom of the second plate, there are disposed two L-shaped plates 33.

When it is desired to install the engaging plate 3 between the two semi-elliptical plates 1, the semi-elliptical plates are pulled outwards first. The L-shaped plates 33 are then aligned with the hollow protrusions 221 and are fixed by a pin 34 penetrating therein. The engaging plate 3 is then flattened, and the semi-elliptical plates are pushed inwards, thus urging the protrusions 32 into the indentations 13 and forming an extended table as shown in FIG. 1.

Figure 3:
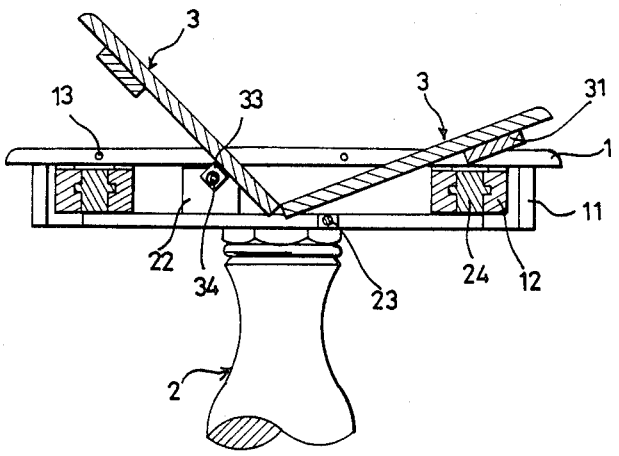
FIG. 3 is a cross-sectional view of the extendable table in partially closed position in accordance with the present invention.
Figure 4:
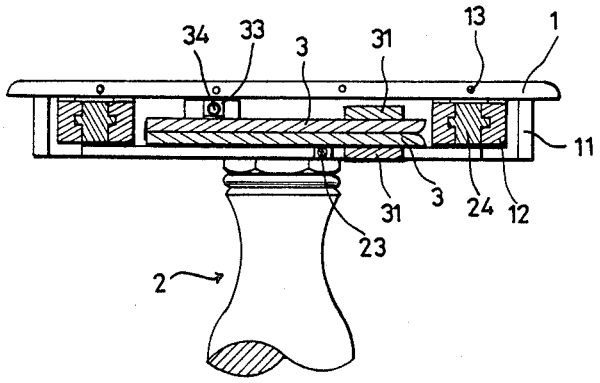
FIG. 4 is a cross-sectional view of the extendable table when an engaging plate has been folded up at its proper place in accordance with the present invention.
Figure 5:
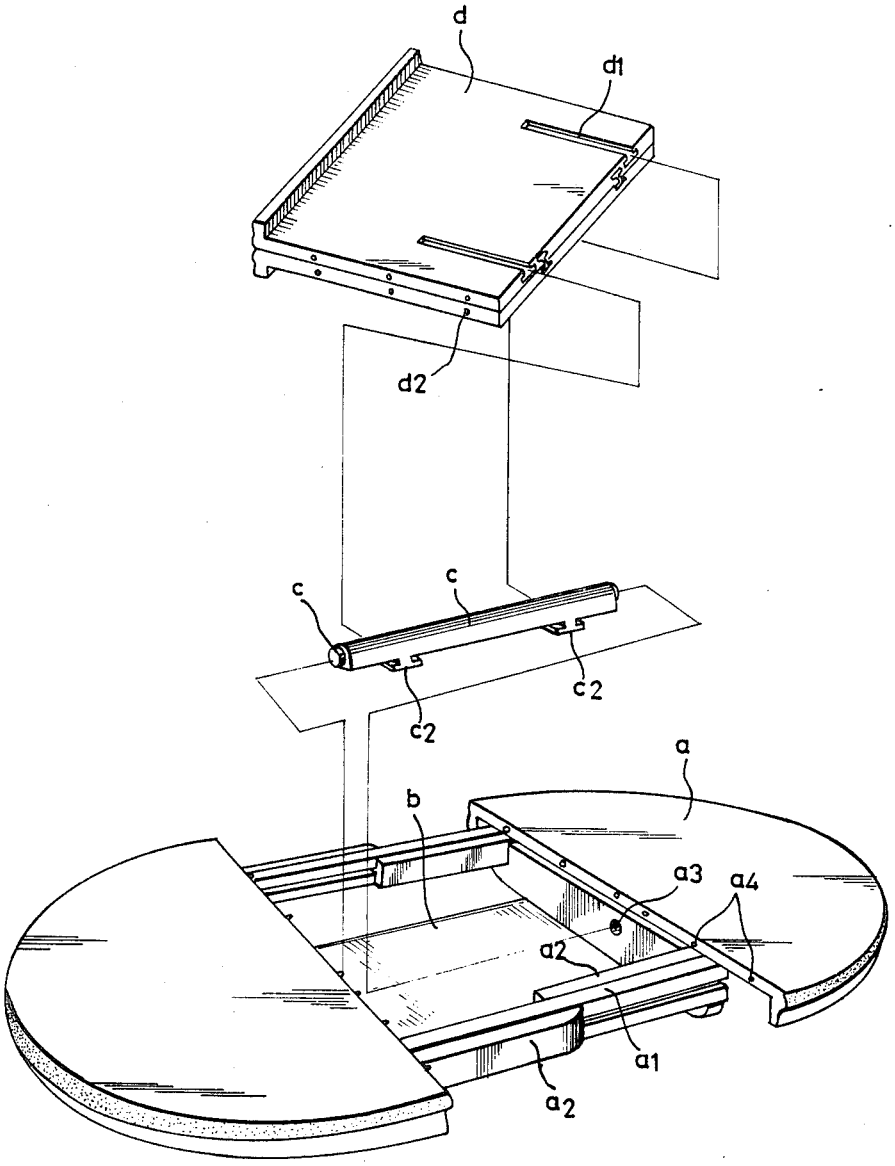
FIG. 5 is an exploded view of an extendable table of the prior art.

When it is intended to decrease the size of the table, the semi-elliptical plates 1 are first pulled outwards, thus retracting the protrusions 32 from the indentations 13. Then the central part of the engaging plate 3 is pressed downwards, the second plate 5 can be rotated with the pin 34 as a pivot and the first plate 4 is moved obliquely, as shown in FIG. 3. When the first and second plates are overlapped together, the engaging plate 3 is pushed continually until the engaging plate 3 is refrained from moving the obstruction of the L-shaped plate 33 and supported by the supporting pins 23. The engaging plate 3 is thus lying horizontally within the rotation space 25, as shown in FIG. 4. Then the two semi-elliptical plates 1 are pushed inwards to make then close together, and the work is done.

As can be plainly seen from the above description, the present invention provides the following advantages over the prior art:

(1) Because of the arrangement of the rotating space 25 and the supporting pin 23, the engaging plate 3 can be rotated very smoothly and supported by the supporting pin 23, thereby providing a simple structure but nevertheless an effectively improved of extendable table structure.

(2) Due to the fact that the engaging plate 3 is fixed at the fixing seat 22 by means of the cooperation of the pin 34 and the hollow protrusion 221, the installation of the engaging plate 3 can be accomplished without the need of great external force. Furthermore, the engaging plate 3 can be rotated in either direction without worrying about whether or not the engaging plate is located in its proper position.

I claim:

1. An improved extendable table structure comprising two table top plates (1), table legs (2), two posts (26), an engaging plate (3) formed of a first plate (4) and a second plate (5) hinged together, a plurality of protrusions (32) being disposed at both sides of said engaging plate (3), a respective edge plate (31) being disposed at a front and a rear side of said engaging plate (3), a pair of side plates (21) being arranged on said two posts (26) separately, both ends of said side plates 21 being connected with two rails (24), said improved extendable table structure being characterized in that: a rotating space (25) is formed between said side plates (21) and said rails (24), a respective fixing seat (22) and a supporting pin (23) being fixed at central locations on each of the two side plates 21, a hollow protrusion (221) being arranged on said fixing seat (22), said second plate (5) having a pair of L-shaped plates (33) respectively disposed at either side of a bottom surface thereof such that a respective pin (34) is penetrable through a pair of L-shaped plates (33) and said hollow protrusions (221) thereby engaging said table top plates (1) and said engaging plate (3).

* * * * *